United States Patent [19]

Koike

[11] Patent Number: 5,033,881

[45] Date of Patent: Jul. 23, 1991

[54] PAPER HOLDING DEVICE FOR PRINTER

[75] Inventor: Seiji Koike, Shizuoka, Japan

[73] Assignee: Tokyo Electric Co., Ltd., Tokyo, Japan

[21] Appl. No.: 430,587

[22] Filed: Nov. 1, 1989

[30] Foreign Application Priority Data

Nov. 4, 1988 [JP] Japan ..... 63-279095

[51] Int. Cl.[5] ..... B41J 2/32; B41J 11/00

[52] U.S. Cl. ..... 400/120; 400/613; 101/288; 242/180

[58] Field of Search ..... 400/611, 613, 613.1, 400/614, 614.1, 615.618, 120; 101/288; 226/189, 190; 242/179, 55.16, 55.17, 55.18, 180, 181, 201, 204, 205, 202

[56] References Cited

U.S. PATENT DOCUMENTS 1,845,462 2/1932 Wellman ..... 242/205
2,512,200 6/1950 Duncan ..... 242/55.3

FOREIGN PATENT DOCUMENTS 0144505 6/1985 European Pat. Off. .
0280036 8/1988 European Pat. Off. .
1549344 10/1970 Fed. Rep. of Germany .
1082085 12/1954 France .
0101484 8/1980 Japan ..... 400/613

OTHER PUBLICATIONS

U.S. -Patent Official Gazette, 8th Mar. 1892; & U.S-.-A-470 429 (J.V. Hulse, Jr.) 30-06-1891.

*Primary Examiner*—Clifford D. Crowder
*Assistant Examiner*—C. A. Bennett
*Attorney, Agent, or Firm*—Oblon, Spivak, McClelland, Maier & Neustadt

[57] ABSTRACT

The present invention provides a paper holding device for a printer which includes a supply arm mounted for pivotal motion on a housing on which a printing station is held. The supply arm holds a supply shaft thereon such that at least the supply shaft may be positioned outwardly of the housing so that paper in the form of a roll having such a large diameter that it cannot otherwise be accommodated in the housing can be used on the printer.

3 Claims, 3 Drawing Sheets

PAPER HOLDING DEVICE FOR PRINTER

FIELD OF THE INVENTION

This invention relates to a paper holding device for a printer which includes a supply shaft on which elongated paper in the form of a roll is wound and a take-up shaft on which the paper is to be taken up.

DISCUSSION OF THE BACKGROUND

At first, a conventional paper holding device for a printer will be described with reference to FIG. 3. Reference numeral 1 denotes a housing having a side plate 2, and a printing station 3 is provided on the housing 3. The printing station 3 includes a platen 4 supported for rotation on the side plate 2, and a thermal head 5 adapted to be contacted under pressure with the platen 4. A supply shaft 8 on which elongated paper 6 in the form of a roll is wound and a take-up shaft 9 are supported for rotation on the side plate 2. The elongated paper here is mounting paper to which a large number of labels 7 are applied. A motor 10 is secured to the housing 1, and a first belt 12 extends between and around a first pulley 11 directly coupled to the motor 10 and another pulley (not shown) secured to an end of the platen 4 while a second belt 13 extends between and around the first pulley 11 and a second pulley 9*a* secured to an end of the take-up shaft 9. Further, a label exfoliating member 14 is secured at an end thereof to the side plate 2 and is adapted to bend the paper 6 (i.e. mounting paper) by an acute angle near the platen 4.

Thus, after a label 7 is printed by the thermal head 3, the platen 4 and the take-up shaft 9 are driven by the motor 10 to feed the paper 6 by a predetermined distance. Thereupon, the label 7 is exfoliated from the paper 6 (mounting paper) by the label exfoliating member 14 while the paper 6 is taken up onto the take-up shaft 9 by an extent over which it is fed.

Since such printer of the type described above is required to be reduced in size similarly to other electronic appliances, there is a limitation in terms of the overall size of the housing 1. On the other hand, while the paper 6 differs in terms of length and also in terms of diameter of the roll thereof where the types thereof differs, since the housing 1 is small in size, there is a limitation in capacity the capability to accommodate the paper 6 therein.

SUMMARY OF THE INVENTION

It is a first object of the present invention to reduce the size of the housing of the printer.

It is a second obJect of the present invention to enable a housing of a small size to be used for paper in the form of a roll having a great diameter.

It is a third object of the present invention to enable operation to be performed in a minimum occupying spacing in accordance with the diameter of the roll of paper.

Other objects of the present invention will become apparent from the following description.

According to the present invention, there is provided a paper holding device for a printer, which is constituted such that it comprises a supply arm having at an end thereof a supply shaft on which elongated paper in the form of a roll is to be held, and a take-up arm having a take-up shaft mounted for rotation at an end thereof, the take-up shaft being connected to a motor, and the supply arm being mounted for pivotal motion on a housing, on which a printing station is held, to selectively position at least the supply shaft thereof to inward and outward positions of the housing such that paper in the form of a roll may be drawn out from the roll. Further, not only the supply arm, but also the take-up arm is mounted for pivotal motion on the housing. Moreover, the supply arm and the take-up arm are mounted for expanding and contracting movement.

Accordingly, when paper in the form of a roll having a small diameter is to be used, the supply arm and the take-up roll are positioned inwardly of the housing together with the supply shaft or the take-up shaft. On the other hand, if at least the supply arm, or the supply arm and the take-up arm are pivoted to position the supply shaft or the take-up shaft outwardly of the housing, then paper in the form of a roll having a large diameter can be mounted onto the supply shaft and the paper after printing can be taken up onto the take-up shaft in a large space outside the housing. Further, where the supply arm and the take-up arm are constructed for expanding and contracting movement, paper in the form of a roll having a further large diameter can be used.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
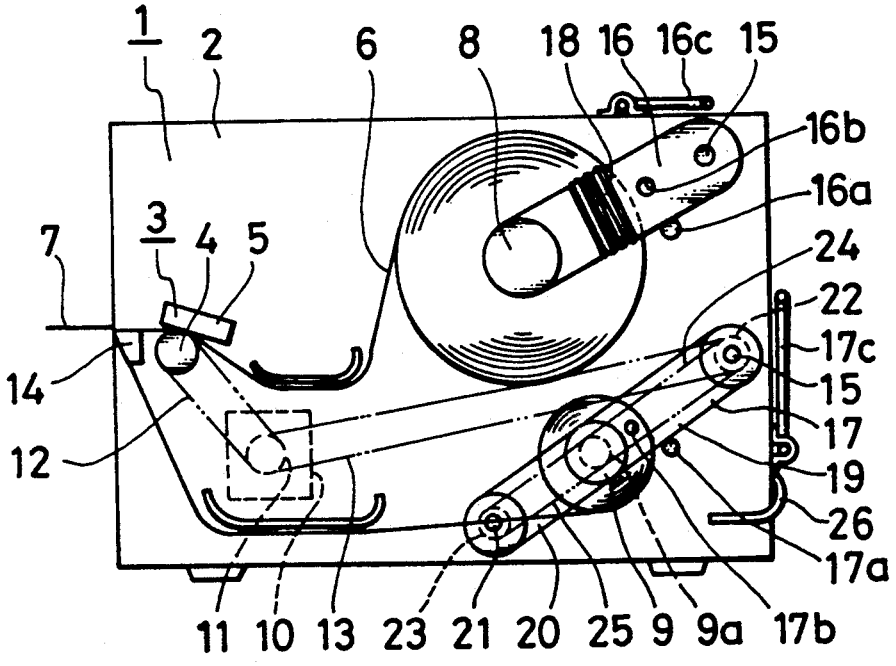
FIG. 1 shows an embodiment of the present invention and is the side elevational view showing the manner of use of paper in the form of a roll having a small diameter.

An embodiment of the present invention will now be described with reference to FIGS. 1 and 2. Those parts which are described hereinabove with reference to FIG. 3 are denoted by like reference numerals, and description thereof is omitted herein. A pair of support shafts 15 are provided on a side plate 2, and a supply arm 16 and a take-up arm 17 are supported for individual pivotal motion on the support shafts 15 between inner and outer positions at which the pivoting free ends thereof are positioned inwardly and outwardly of the housing 1, respectively. At the inner positions, the supply arm 16 and the take-up arm 17 are positioned by a pair of stoppers 16*a* and 17*a*, respectively. Further, a pair of hang bars 16*c* and 17*c* are provided on the side plate 2 for resiliently engaging with an arresting hole 16*b* of the supply arm 16 and another arresting hole 17*b* of the take-up roll 17 to fix the supply arm 16 and the take-up arm 17 at individually arbitrary positions. The supply shaft 8 has a bellows portion 18 at an intermediate location thereof. The bellows portion 18 is expanded or contracted by an external force greater than a predetermined level, but where the external force is smaller than the predetermined level, the bellows portion 18 is not expanded nor contracted and maintains its original fixed form. The take-up arm 18 is composed of two arms 19 and 20 connected for pivotal motion to each other by means of a shaft 21. The arms 19 and 20 have arresting portions (not shown) which are resiliently engaged with each other to maintain the relative positions of the arms 19 and 20 in a stable condition. A pulley 22 is fitted for rotation on an end of one of the support shafts 15 on which the take-up arm 17 is supported, and a belt 13 extends between and around the pulley 22 and another pulley 11 which is directly coupled to the motor 10. Another belt 24 extends between and around the pulley 22 and a further pulley 23 which is fitted for rotation on an end of the shaft 21, and a further belt 25 extends between and around the pulley 23 and a still further pulley **9*a* secured to an end portion of the take-up shaft 9. Further, a paper guide 26 is secured to a lower portion of the housing 1 and is located below the support shafts 15**.

In the paper holding device having such a construction as described above, when the motor 10 is energized to rotate, rotation thereof is transmitted to the take-up shaft 9 by way of the belts 13, 24 and 25 so that the paper 6 fed by the platen 4 is taken up by the take-up shaft 9. Then, in case the roll of the paper 6 to be used has a small diameter, the supply arm 16 is positioned inwardly of the housing 1 together with the supply shaft 8 while the take-up arm 17 is also positioned inwardly of the housing 1 together with the take-up shaft 9 as shown in FIG. 1.

Figure 2:
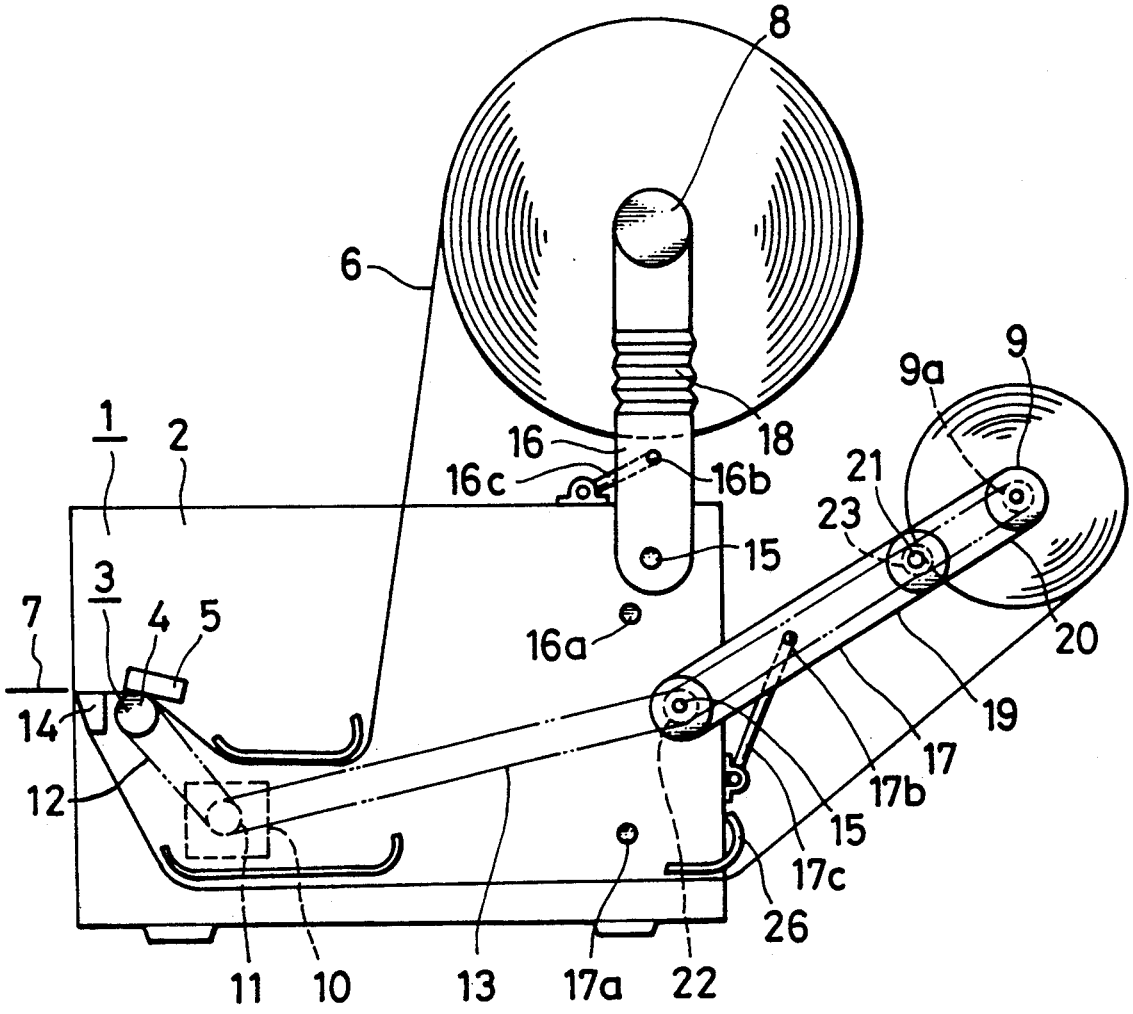
FIG. 2 is a side elevational view showing the manner of use of paper in the form of a roll having a large diameter.
Figure 3:
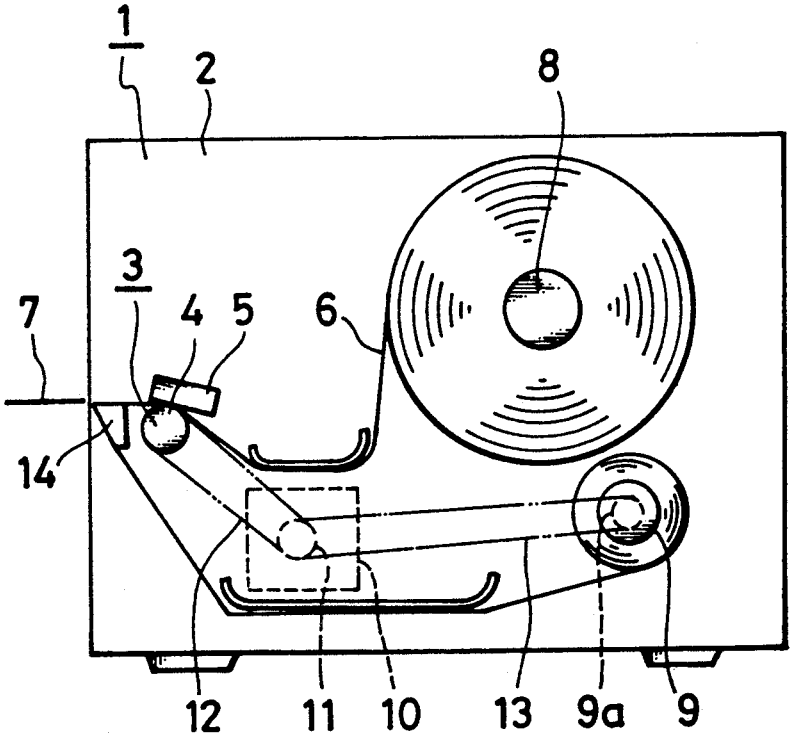
FIG. 3 (PRIOR ART)
FIG. 3 is a side elevational view showing a conventional paper holding device for a printer.

On the other hand, in case the roll of the paper 6 to be used has a large diameter, the supply arm 16 and the take-up arm 17 are individually pivoted around the support shafts 15 until the pivoting free ends thereof are positioned outwardly of the housing 1 as shown in FIG. 2. Further, if an external force greater than the predetermined level is applied to expand the bellows portion 18 of the supply arm 16, then the roll of the paper 6 having a large diameter can be mounted onto the supply shaft 8 without interfering with the support shafts 15. Also with regard to the take-up arm 17, if the arms 19 and 20 are expanded into a linear condition by pivoting the arm 20 with respect to the arm 19 around the shaft 23, then a large amount of the paper 6 can be taken up onto the take-up shaft 9 without interfering with the support shafts 15. In this instance, if the paper 6 is introduced to the take-up shaft 9 by means of the paper guide 26, then possible interference between the paper 6 and the take-up arm 17 can be prevented.

While a label in the embodiment described above is suitable to print thereon a bar code such as a commodity code and contents of a commodity name, a unit price, a price and so forth, some other paper such as plain paper on which no such label 7 is provided may otherwise be used in the printer.

Further, while in the embodiment described above the supply arm and the take-up arm are described mounted for pivotal motion, the paper holding device of the present invention can be used also with a printer of the type wherein mounting paper is not taken up but is left as it is after it has been discharged from the printer. In this instance, only the supply arm may be mounted for pivotal motion on the housing while the take-up arm is omitted.

What is claimed is:

1. A paper holding device for a printer, which comprises:

a housing; having a printer station mounted thereon;

a supply arm having a supply shaft at an end thereof on which elongated paper in the form of a roll is to be held, and a take-up arm having a take-up shaft mounted for rotation at an end thereof, a motor connected to said take-up shaft;

means for pivotally mounting said supply arm on said housing; and means for selectively positioning and fixing at least said supply arm to inward and outward positions with respect to said housing such that paper in the form of a roll may be drawn out from said roll.

2. A paper holding device for a printer, which comprises:

a housing having a printing station mounted thereon;

a supply arm having a supply shaft at an end thereof on which elongated paper in the form of a roll is to be held, a take-up arm having a take-up shaft mounted for rotation at an end thereof, a motor connected to said take-up shaft;

means for mounting said supply arm and said take-up arm for individual pivotal motion on said housing and;

means for selectively positioning and fixing said supply arm to inward and outward positions of said housing such that paper in the form of a roll may be drawn out from said roll and taken up onto said take-up shaft, respectively.

3. A paper holding device for a printer according to claim 1, wherein said take-up arm includes means for expanding and contracting movement thereof.

* * * * *